United States Patent [19]

Ross

[11] 4,357,767

[45] Nov. 9, 1982

[54] NAME PLATE SYSTEM

[76] Inventor: Klaus D. Ross, 770 Lakeshore Dr. #706, Dorval, Quebec, Canada

[21] Appl. No.: 201,194

[22] Filed: Oct. 27, 1980

[30] Foreign Application Priority Data

Dec. 28, 1979 [CA] Canada ..... 342804

[51] Int. Cl.[3] ..... A44C 3/00

[52] U.S. Cl. ..... 40/1.5

[58] Field of Search ..... 40/1.5, 17, 10 R, 10 D

[56] References Cited

U.S. PATENT DOCUMENTS

| | | | |
|---|---|---|---|
| 2,396,160 | 3/1946 | Coulter | 40/1.5 |
| 2,730,824 | 1/1956 | Cohen | 40/1.5 |
| 2,795,876 | 6/1957 | Hayes | 40/1.5 |
| 2,832,161 | 4/1958 | Murphy | 40/1.5 |
| 2,834,129 | 5/1958 | Kirkbridge | 40/1.5 |

*Primary Examiner*—Gene Mancene
*Assistant Examiner*—Wenceslao J. Contreras
*Attorney, Agent, or Firm*—Cushman, Darby & Cushman

[57] ABSTRACT

The disclosure herein describes a name plate system consisting of a base plate provided on one face thereof with guide rails on which indicia bearing cover plates are adapted to engagedly slide; a pair of locking bars mounted at each extremity of the base plate serve to hold the cover plate to the base plate; a resilient retainer element mounted to the base plate serves to secure the locking bar in engagement with the base plate; the base plate is cut from a modular base plate so patterned as to allow various sizes of base plates to be cut.

9 Claims, 11 Drawing Figures

NAME PLATE SYSTEM

FIELD OF THE INVENTION

The present invention relates to a name plate system to be used as small name plates or large directory boards.

BACKGROUND OF THE INVENTION

One type of name plate system presently used consists of a base plate having on its top face one or more pairs of guide rails on which may be slid an indicia bearing cover plate. In one such system, as described for example in Swiss patent No. 548,080 published April 11, 1974 to W. Kubli, a pair of locking bars are inserted at each opposite extremities between the base plate and the cover plate to secure the latter together. Such system, however, does not provide for a tight interlocking engagement between the components making up the name plate.

Another problem associated with present name plate systems is that base plates and cover plates as well as locking bars are of standard sizes or manufactured and cut to size according to customer requirements. Thus, the lack of flexibility in sizes of cover plates and base plates in cases where the display volume is important becomes extremely costly.

OBJECTS AND STATEMENT OF THE INVENTION

It is an object of this invention to provide a name plate system wherein a tight interlocking arrangement between the various components of the system is achieved. This is accomplished by adding to the system a resilient retainer element which opposes any tendency of the locking bar from being removed from the base plate.

It is a further object of the present invention to provide a basic module from which multiple base plates of various sizes may be formed to be used either as individual name plates or as large directory boards. This is achieved by providing a modular base plate where a plurality of pairs of guide rails are so arranged on the top face of the base plate so that various sizes of base plates may be severed to form individual name plates.

The present invention therefore relates to a name plate which comprises in its broadest aspect: a base plate having a flat surface and displaying on this surface at least one pair of guide rails and a pair of lugs disposed adjacent each opposite extremity of the surface; cover plate means in spaced covering engagement with the base plate, the cover plate means having, on one face thereof, two longitudinal extending parallel flanges adapted to slidably and graspingly engage the guide rails of the base plate; a pair of locking bars mounted at the opposite extremities of the base plate and each having a portion adapted to be inserted between the cover and the base plate to close these extremities; this portion includes notch means adapted to engage the lugs; and resilient retainer means mounted at opposite ends of the base plate and consisting of a member secured to the base plate between the guide rails, the member including a flexible arm extending longitudinally toward the locking bar and contacting the locking bar when the lug is engagedly received in the notch means; the arm applying pressure on the portion of the locking bar in order to maintain the notch means in tight engagement with the lugs, said pressure capable of being overcome to manually disengage the locking bar from the base plate.

In one form of the invention a mechanical locking device, in the form of a small metallic disc, is inserted between the cover plate and the base plate preventing the manual dislodging of the notch means from the lugs. In one form of the invention, this metallic disc can be moved in the locked and unlocked position by means of a magnet being moved over a cover plate.

The present invention also pertains to a modular base plate for use in making name plates as described above, which comprises in its broadest aspect: a flat body formed of severable material and displaying on one face thereof rows of cover-receiving sections extending lengthwise of the body; each row is formed of a plurality of pairs of guide rails and of lugs disposed at opposite extremities of the guide rails, the guide rails and the lugs being integrally mounted to the body; the guide rails and the lugs of each row are disposed in alignment and have a cross-section shaped to slidably and graspingly receive indicia bearing cover plates thereon; the guide rails of each pair have substantially the same length, and the lugs adjacent the opposite extremities of the guide rails are vertically aligned with respect to one another so as to form multiple base plates which are severable to form individual name plates.

Other objects and scope of applicability of the present invention will become apparent from the detailed description given hereinafter; it should be understood, however, that this description, while indicating preferred embodiments of the invention, is given by way of illustration only since various changes and modifications within the spirit and scope of the invention will become apparent to those skilled in the art.

DESCRIPTION OF PREFERRED EMBODIMENTS

Figure 1:
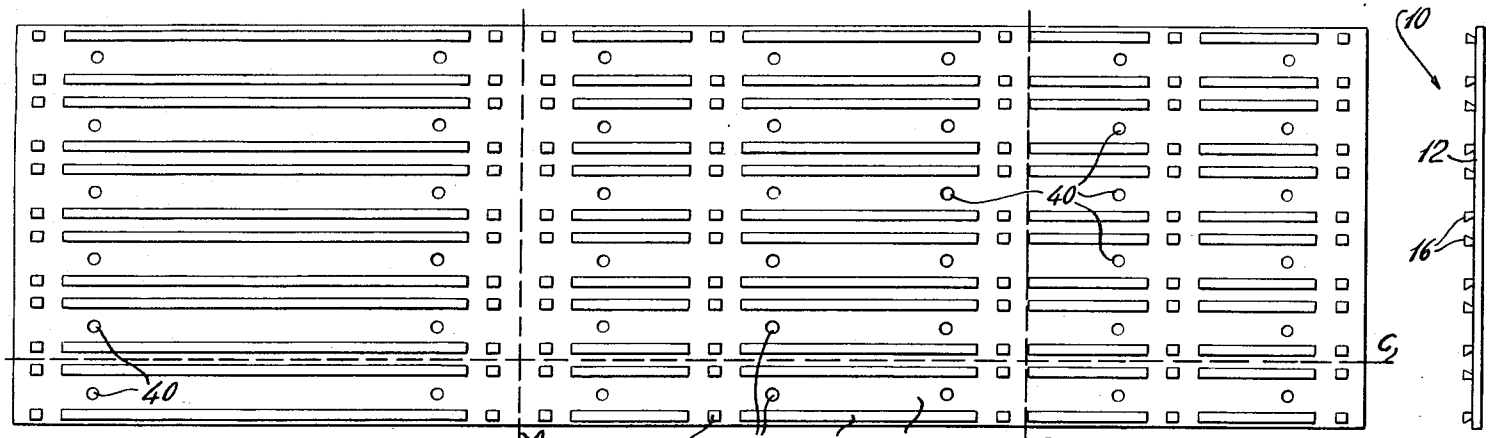
FIG. 1 is a plan view of a modular base plate made in accordance with the present invention.
Figure 2:
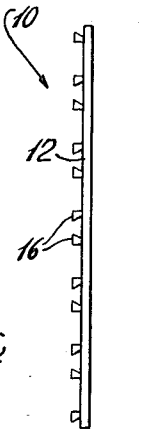
FIG. 2 is a side view thereof.

Referring to FIGS. 1 and 2, there is shown a modular base plate 10 made in accordance with the present invention; it comprises a flat rectangular body 12, the top face of which displays rows of guide rails 14 and of lugs 16. The body 12 is formed of a plastic material which is easily severable so that it can be cut to form an individual base plate as described hereinbelow. One plastic material which has been found suitable for the modular base plate of the present invention is the one known under the trade mark ABS. The length and width of the base plate section shown in FIG. 3 were obtained by cutting the modular base plate 10 of FIG. 1 along dotted lines A, B and C. Although not shown, these cutting lines could be marked on the top surface of the base plate to facilitate the cutting location of base plates.

The lugs and the guide rails all have the same cross-section; the guide rails of each section are parallel to one another and have the same length. Similarly, lugs 16 are vertically aligned with respect to one another.

Figure 3:
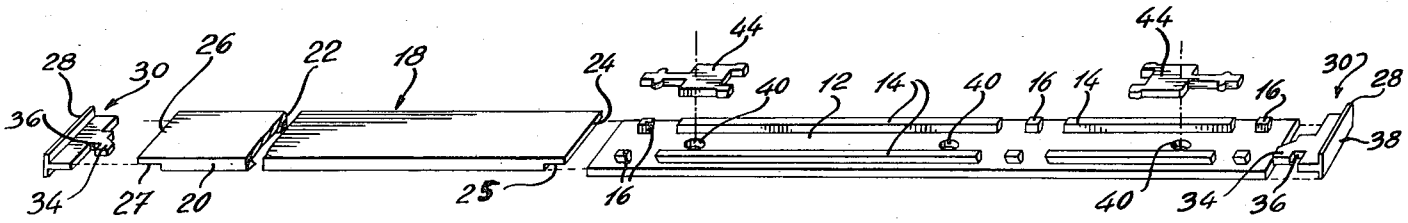
FIG. 3 is an exploded view of a name plate having a base plate formed from the modular base plate shown in FIG. 1.

FIG. 3 shows how a name plate is formed. As mentioned above, this name plate was formed by cutting off a section from modular base plate 10. This name plate has a base plate or body 12 of a rectangular shape and includes two pairs of guide rails 14 and three sets of pairs of lugs 16. The name plate assembly further includes a cover 18 which has on its inner face, along the edges thereof, inwardly turned flanges 20 and 22 having a cross-section corresponding to the cross-section of the guide rails and lugs. Flanges 20 and 22 terminate short of the opposite edges 24 and 26 of the cover so that, when the cover is slid over the base plate 12 in engagement with the guide rails and lugs, there is a recess 25,27 adjacent each edge 24,26 respectively. At the opposite extremities of the name plate, a pair of locking bars 28 each include a generally rectangular web 30 which is insertable between the cover plate and the base plate to close the gap formed by recess 25,27 and the extremities of the base plate and the cover plate. Web 30 includes also a leg portion 34 with a notch 36 having a size corresponding substantially to the size of a lug 16 so that the latter may be tightly received therein. Web 30 extends centrally from one side of the flat vertical rectangular end surface 38 of locking bar 28, the end surface completely covering the extremity of the cover and base plate when assembled thereover. The locking bar is said to be symmetrical in that web 30 can be inserted from the right or the left of the name plate as seen in FIG. 3.

The base plate is provided with a series of holes 40 located between the guide rails. These holes receive, in tight snap-in engagement, projections 42 (see FIG. 4) integrally mounted to the under face of a retainer element 44. This element is formed of a resilient plastic material, such as that known under the trademark nylon. It includes an integrally mounted arm portion 48 which, due to its dimension and the material of the element, is flexible and extends longitudinally towards the locking bar 28.

Figures 4, 5, 6, 7, 8:
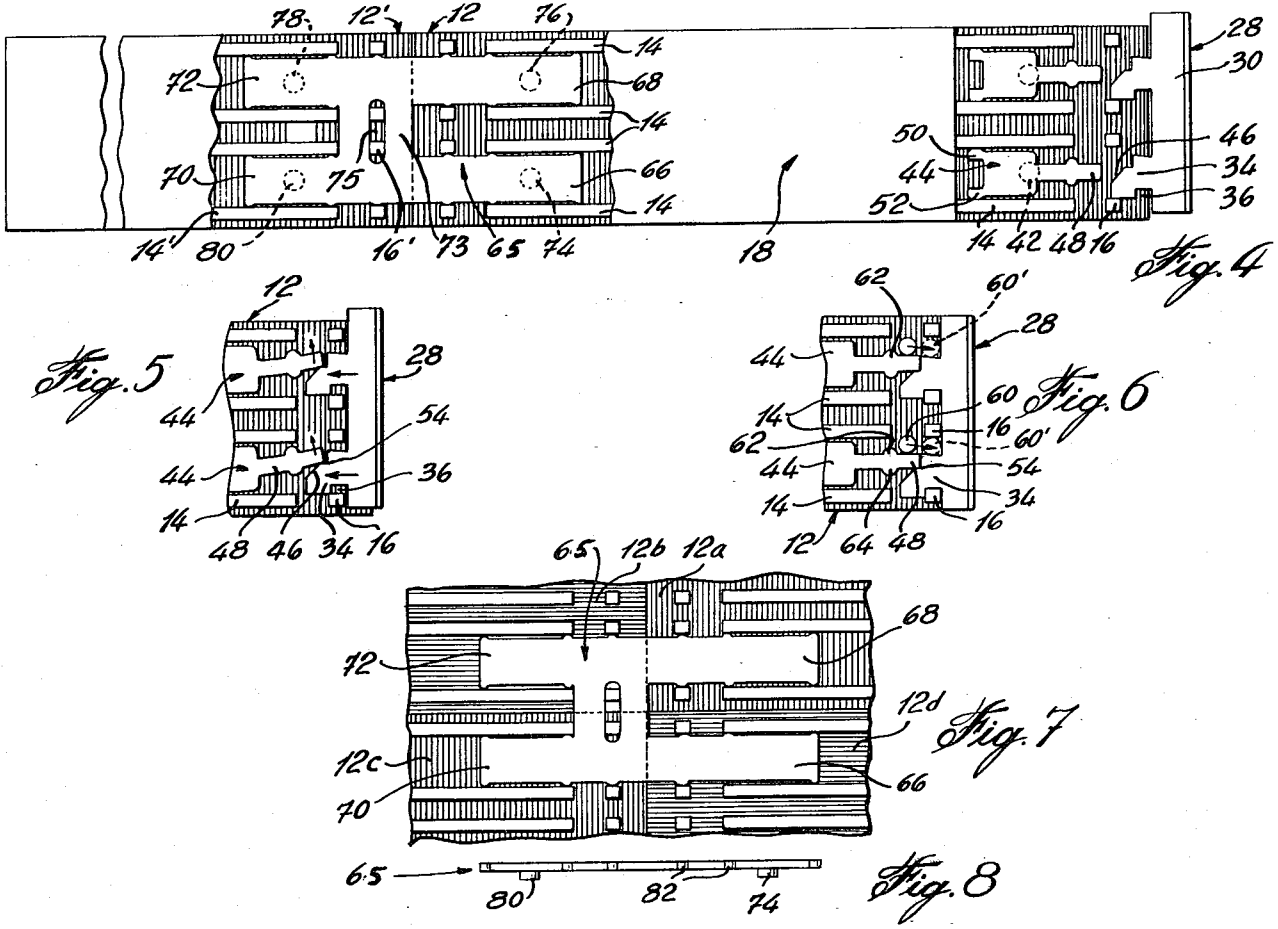
FIG. 4 is an elevational view of another name plate with the cover partly broken illustrating two base plates interconnected by a linking member and showing one locking bar prior to its being engaged to the base plate.
FIG. 5 is an elevational view of one extremity of the base plate shown in FIG. 4 illustrating the locking bar being engaged to the base plate.
FIG. 6 is an elevational view similar to that of FIG. 5 showing the locking bar in engagement with the base plate and illustrating the displacement of a small locking disc for securing the locking bar to the base plate.
FIG. 7 is an elevational view showing the interconnection of four individual base plates.
FIG. 8 is a side view of a linking member such as that shown in FIG. 7.

Further explanation of the assembly of the base plate, locking bar and retainer element will now be described with reference to FIGS. 4, 5 and 6 wherein there is shown a base plate consisting of two rows of pairs of guide rails and of lugs. The leg portion 34 of the locking bar has a ramp 46 which is contacted by the extremity of the flexible arm extension 48 of the retainer element 44. As can be seen in FIG. 5, once portion 34 is inserted endwise between the cover and the base plate, ramp 46 causes arm portion 48 to flex upwardly forcing the lower part of leg portion 34 downward between the extremity of the lower guide rail and the adjacent lug and to engage notch 36 on lug 16. The retainer element 44 has two leg extensions 50 and 52 that bear against the parallel rails 14 centering element 44 between the guide rails. As can be seen in FIG. 6, in the engaged position, the extremity of arm portion 48 sits in a shoulder section 54 of the leg portion 34 to firmly hold the locking bar 28 to the base plate 12.

The locking bar is made of a plastic material similar to that of the base plate, however, the cover is made of metal, such as anodized aluminum or plastic which can be engraved, silk screened, etched or painted. The cover plate preferably has a brushed surface with clear anodized finish. To lock the name plate components, a small metallic disc 60 is placed on the arm portion 48 (see FIG. 6). The width of leg portion 34 between two vertically disposed lugs 16 is somewhat smaller than the distance separating the two lugs so that once the notch 36 of the arm portion 34 is engaged with the lower of two lugs 16, there remains a space between its upper edge with the upper lug 16. With the disc 60 sitting on the arm 48, the cover is slid over and engaged with the base plate and the two locking bars mounted at opposite extremities of the base plate. A magnet is then placed over the cover plate in registry with the disc 60. Movement of the magnet to the right in FIG. 6 will cause disc 60 to move into 60'. In this position, the locking bar cannot be removed providing some vandal-proof arrangement.

Arm portion 48 has a pair of oppositely disposed bosses 62 and 64. Boss 62 prevents the metal disc from moving inwardly with respect to the retainer element 44 to prevent jamming while boss 64 performs the same function when element 44 is engaged to the base at the opposite side of the base (i.e. to the left).

Referring to FIGS. 4, 7 and 8, there is shown a linking element 65 which serves to connect adjacent base plates to one another. In FIG. 4, the linking element 65 connects lengthwise two similarly constructed base plates 12 and 12' while, in FIG. 7, the linking element interconnects four base plates **12*a*, 12*b*, 12*c*, 12*d* which may have similar or varying shapes. In FIG. 4, the linking element 65 has a first pair of leg extensions 66 and 68 which are engaged between two superposed pairs of guide rails 14 of base plate and a second pair of leg extensions 70 and 72 which are engaged between two superposed pairs of guide rails 14' of base plate 12'. These leg extensions are integral with a connecting portion 73 that includes an opening 75 to receive the pair of lugs 16'. It will be evident to the man skilled in the art that linking element 65 in FIG. 4 could be replaced by two separate longitudinally extending elements that would include extensions 68 and 72 in one case and extensions 66 and 70 in the other case to connect the base plates 12 and 12' together; the connecting portion 73 only provides additional rigidity in the linking element. On the other hand, portion 73 is required in the case of the interconnection of FIG. 7 where extensions 66, 68, 70 and 72 are engaged with base plates 12*b*, 12*a*, 12*c* and 12*d*, respectively. In both FIGS. 4 and 7, the engagement of the linking extensions to their respective base plate is accomplished by means of projections 74, 76, 78 and 80 which are integrally mounted to the underface of the leg extensions and are shaped to be received in a snap-in engagement in holes 40 provided in the base plate. Also, to improve stability of the linking extensions in their respective location longitudinally spaced bosses 82** are provided along the edges of the leg extensions and bear against the guide rails and the lugs.

In cases where no linking elements 65 nor resilient retainer elements 44 are needed, holes 40 may serve as fastening members to secure an individual name plate or an assembly name plates to a backing or the like.

The linking elements are made of a plastic material similar to that of the locking bars 28 and the base plate 10. These elements are preferably injection moulded to provide accurate spacing and dimensions to thereby provide a precision system when compared to presently known systems.

Figure 9:
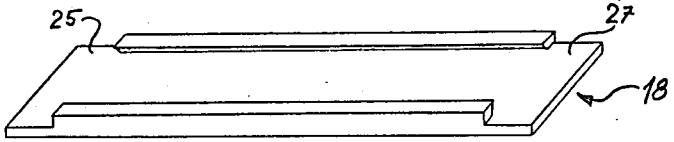
FIG. 9 is a bottom perspective view of the cover plate made in accordance with the present invention.
Figure 10:
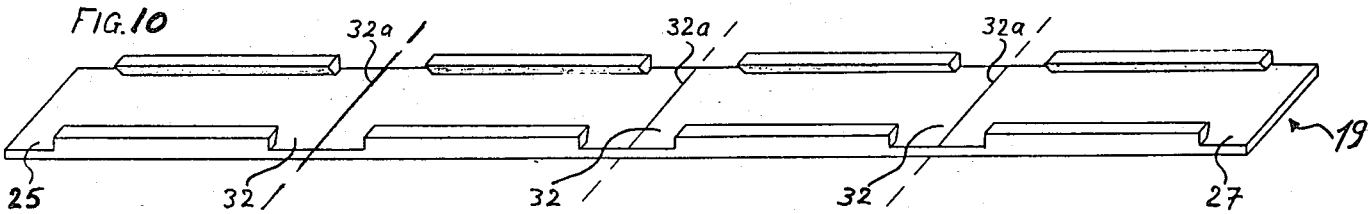
FIG. 10 is a bottom perspective view showing an element from which a plurality of cover plates in accordance with the present invention can be made.

Cover plates 18 may be manufactured from extruded profiles. A material removing process is necessary to create the recesses 25 and 27 which accept the locking bars. Considerable costs can be saved if the modular system, as used for the base plates, is applied to cover plates and these are also injection moulded. FIGS. 9 and 10 show cover plates 18 and 19 for engraving or silk-screening which already have recesses 25 and 27 to accommodate the locking bar 28. Combined recesses 32 are transformed into recess 25 or 27 if the module is severed along guide line 32*a*.

Figure 11:
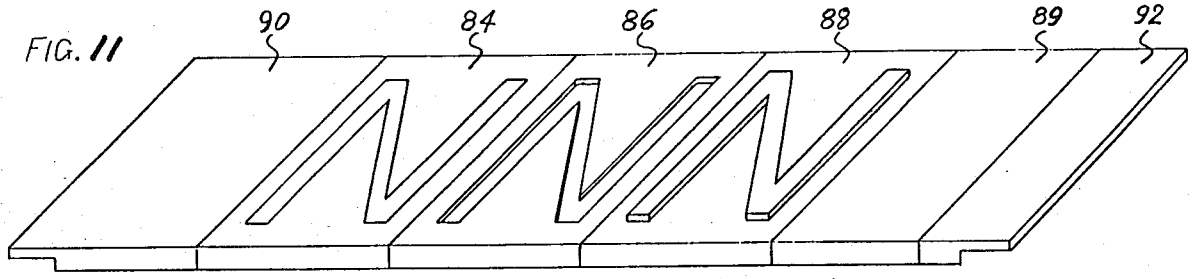
FIG. 11 is a variant of a cover plate made in accordance with the present invention.

To further expand the usefulness of the system, modules with premoulded letters as shown in FIG. 11, surface flush 84, indented 86 or raised (relief) 88 can be produced. Combined with filler 89 and finishing modules 90 and 92, which are blank and are produced in different lengths and colors, another model line is added to the system. Modules 84 are lettered in contrasting colors by means of a special process and cannot be altered. Modules 86 and 88 however can be colored or recolored subsequently by filling or rolling module 86 and by rolling only, module 88 in any desired color.

The embodiments of the invention in which an exclusive property or privilege is claimed are defined as follows:

1. A name plate comprising:

a base plate having a flat surface and displaying on said surface at least one pair of guide rails and a pair of lugs disposed adjacent each opposite extremity of said surface;

cover plate means in spaced covering engagement with said base plate; said cover plate having, on one face thereof, two longitudinal extending parallel flanges adapted to slidably and graspingly engage said guide rails of said base plate;

a pair of locking bars mounted at said opposite extremities of said base plate and each having a portion adapted to be inserted between said cover and said base plate to close said extremities; said portion including notch means adapted to engage said lugs at said extremities; and resilient retainer means mounted at opposite ends of said base plate; said resilient retainer means consisting of a member secured to said base plate between said guide rails, said member including a flexible arm extending longitudinally toward said locking bar and contacting said portion of said locking bar when said lug is engagedly received in said notch means; said arm applying pressure on said portion of said locking bar to maintain said notch means in engagement with said lugs, said pressure capable of being overcome to manually disengage said locking bar from said base plate.

2. A name plate as defined in claim 1, wherein said portion of said locking bar includes a ramp for guidingly displacing the extremity of said arm of said member during engagement and disengagement of said locking bar with and from said base plate.

3. A name plate as defined in claim 1, further comprising holes in said base plate between said flanges at said opposite ends; said member including a projection adapted to be fitted in tight engagement in said holes.

4. A name plate as defined in claim 1, wherein said portion of said locking bar has a width smaller than the distance separating two vertically disposed lugs at said extremities thereby defining a gap between said portion and one of said lugs when the other lug is engaged in said notch means; said name plate further including a locking disc adapted to occupy and be slid into said space to provide a locking engagement of said locking bar to said base plate.

5. A name plate as defined in claim 4, wherein said disc is metallic and displaceable in and out of said space when said cover extends over said base plate by means of a magnet.

6. A name plate as defined in claim 5, wherein a boss is provided on said arm for preventing excessive inward movement of said disc relative to said locking bar.

7. A name plate as defined in claim 1, further comprising linking members secured to said base plate for connecting two or more of said base plates together; said linking members being flat and extending between said cover and said base plate; said linking members being shaped to fittingly be received between said guide rails.

8. A name plate as defined in claim 7, wherein said linking members include, along the edges thereof, longitudinally spaced bosses adapted to contact adjacent guide rails and lugs on said base plates.

9. A name plate as defined in claim 7, wherein said base plate includes holes located between said guide rails; projections being provided on said linking members to fit in said holes for tight engagement with said base plate.

* * * * *